US008590642B2

(12) United States Patent
Robey et al.

(10) Patent No.: US 8,590,642 B2
(45) Date of Patent: Nov. 26, 2013

(54) PERCUSSION HAMMER BIT RETENTION SYSTEM

(76) Inventors: Danny Robey, Benton, IL (US); Todd Taylor, Benton, IL (US)

( * ) Notice: Subject to any disclaimer, the term of this patent is extended or adjusted under 35 U.S.C. 154(b) by 336 days.

(21) Appl. No.: 13/066,414

(22) Filed: Apr. 14, 2011

(65) Prior Publication Data

US 2011/0253458 A1 Oct. 20, 2011

Related U.S. Application Data

(60) Provisional application No. 61/342,443, filed on Apr. 14, 2010.

(51) Int. Cl.
*E21B 10/36* (2006.01)

(52) U.S. Cl.
USPC ..... 175/414; 175/294

(58) Field of Classification Search
USPC ..... 175/414, 415, 293, 294, 300
See application file for complete search history.

(56) References Cited

U.S. PATENT DOCUMENTS

2010/0252330 A1* 10/2010 Gilbert et al. ..... 175/293

* cited by examiner

*Primary Examiner* — Brad Harcourt
(74) *Attorney, Agent, or Firm* — Gary K. Price

(57) ABSTRACT

A percussion hammer bit retention system including a retainer having at least three (3) tabs, a hammer bit having first and second elevated surfaces that each define pathways and slot openings for rotational receipt of the tabs, and a custom chuck further including slot openings for receipt of the tabs. The application of tabs in combination with the elevated surfaces and indexed slot openings distinguish the present invention over the prior art. In application, in order to fully separate the retainer from the assembly, the tabs are indexed in a manner that only allows them to pass through the aligned slot openings on the first elevated surface in one (1) position every 360 degrees, and then through the aligned slot openings on the second elevated surface in one (1) position every 360 degrees, and then through the indexed slots on the custom chuck in one (1) position every 360 degrees.

19 Claims, 4 Drawing Sheets

PERCUSSION HAMMER BIT RETENTION SYSTEM

CROSS REFERENCES TO RELATED APPLICATIONS

U.S. Provisional Application for Patent No. 61/342,443, filed Apr. 14, 2010, with title "Percussion Hammer Bit Retention System" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to a bit retention system and more particularly to an apparatus designed to retain and retrieve the head of a hammer/percussion bit in the event of separation or breakage of the head from the upper shank portion of the bit.

2. Brief Description of Prior Art

Percussion Hammer bit systems are commonly used in drilling or boring through the earth's surface. During application, it is known for the bit to fail and crack or break across the shank of the bit during drilling. Such failures often lead to "fishing" jobs which use expensive techniques to retrieve the broken bit from the well bore. In fact, most hammer bits in the art now include a fishing thread formed into the head of the bit to facilitate retrieving a broken head from a drilled hole. However, even bits having this fishing thread feature still results in a fishing operation to retrieve the broken bit head resulting in added expense to the operation.

The prior art is well supplied with variations and designs in order to retain the bit head to the hammer in the event of cracking and breakage. While each of the prior art systems may be unique in design, none of these provide the features of the current invention.

Thus there is a need for a system for retaining and retrieving broken percussion hammer drill bits. Further, it is advantageous for such a system (1) continue to retain a connection to the broken piece, (2) have a means for resisting disconnecting, and (3) protect the assembly as it is removed from the drill hole. The present retaining system meets these objectives.

SUMMARY OF THE INVENTION

A percussion hammer bit retention system generally including a retainer, a hammer bit, and a custom chuck. The retainer includes an inner surface preferably having three (3) tabs equally spaced about the circumference of a lower end of the inner surface. The retainer further includes an edge disposed on an upper end of the inner surface. The custom chuck includes a ledge disposed on the outer surface such that in application, the edge is in abutting communication with the ledge. The ledge further includes a plurality of indexed slots, the number of indexed slots being equal to the number of tabs on the retainer. Further, the indexed slots are equally spaced about the circumference of the ledge such that in application, the tabs can be aligned with the indexed slots.

The hammer bit defines a first elevated surface and a second elevated surface that defines a pathway therebetween.

The first elevated surface includes a plurality of equally spaced first slot openings, the number of first slot openings being equal to the number of tabs on the retainer such that the tabs can be aligned with the first slot openings. The second elevated surface includes a plurality of equally spaced second slot openings, the number of second slot openings being equal to the number of tabs on the retainer such that the tabs can be aligned with the second slot openings. The first slot openings are not in vertical alignment with the second slot openings and, the indexed slots are not in vertical alignment with the second slot openings.

In application, the tabs are indexed in a manner that only allows them to pass through the aligned first slot openings on the first elevated surface in one (1) position every 360 degrees, and then through the second elevated surface in one (1) position every 360 degrees, and then through the indexed slots on the custom chuck in one (1) position every 360 degrees. For example, should the bit head separate from the bit or while positive lifting pressure is applied while the hammer bit is not assembled, the tabs must first align and pass through the first slot opening. The retainer must then be selectively rotated approximately 180 degrees along the pathway with positive pressure in order to allow the retainer tabs to align and pass through the second slot openings on the second elevated surface. Once the tabs on the retainer are aligned with the second slot openings positive lifting pressure must be applied to free the retainer from the broken section (shank) of the hammer bit. The next step is to align the tabs with the corresponding indexed slots of the custom chuck in order to fully separate the retainer from the assembly.

DESCRIPTION OF THE PREFERRED EMBODIMENT

Figure 1:
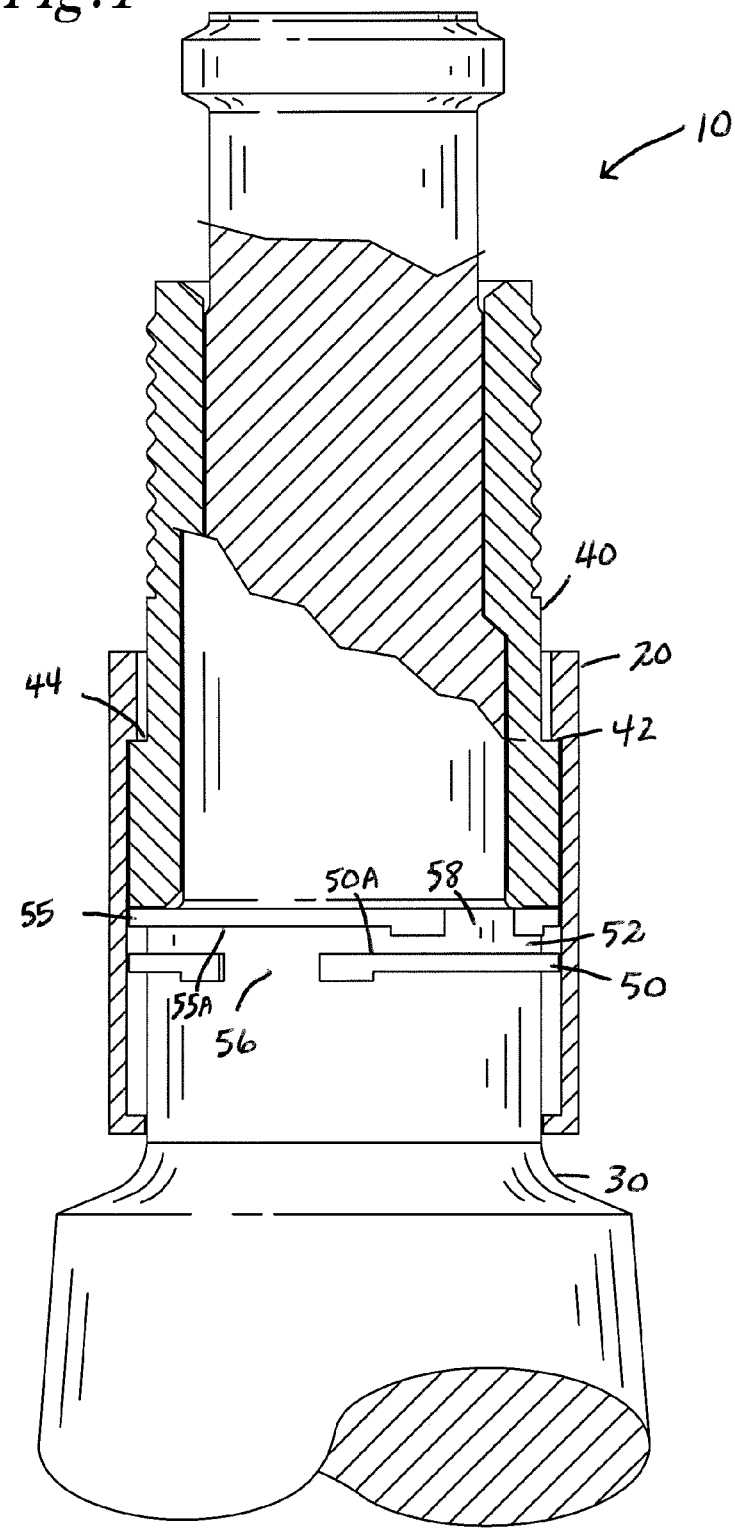
FIG. 1 illustrates a preferred embodiment of the present invention, a percussion hammer bit retention system.

The apparatus of the present invention is directed to a bit retention system for retaining and retrieving the head of a hammer percussion bit in the event of separation or breakage of the head from the upper shank portion of the bit. The present system utilizes a fixed elevated indexed tab system that provides positive connectivity with forward and reverse rotation during extraction of a broken or detached head. As will be described, the percussion hammer bit retention system consists of components configured and correlated with respect to each other so as to attain the desired objective.

Referring to FIGS. 1-4, the percussion hammer bit retention system, indicated generally at 10, comprises a retainer 20 having, in the preferred embodiment, at least three (3) tabs 25, a hammer bit 30 having as will be described elevated surfaces that define pathways and slot openings for rotational receipt of the tabs 25. As will be understood, the application of tabs 25 in combination with the elevated surfaces as will be described, distinguishes the present invention over the prior art.

As illustrated, the retainer 20 has a cylindrical configuration and includes an inner surface 22 having an upper end 26 and a lower end 27. In the preferred embodiment the retainer 20 includes three (3) tabs 25 equally spaced about the circumference of the lower end 27 of the inner surface 22. As will be understood, the circumference of the inner surface 22 is sized to fit over and receive a custom chuck 40, which custom chuck 40 is sized to receive the upper shaft portion 32 of the hammer bit 30.

The retainer 20 further includes an edge 28 disposed on the upper end 26 of the inner surface 22. The custom chuck 40 includes a ledge 42 disposed on the outer surface 43 such that in application, the edge 28 is in abutting communication with the ledge 42 and serves as a stop in order to prevent the custom chuck 40 from passing completely through the retainer 20. The ledge 42 further includes a plurality of indexed slots 44, the number of indexed slots 44 being equal to the number of tabs 25 on the retainer 20. Further, the indexed slots 44 are equally spaced about the circumference of the ledge 42 such that in application, the tabs 25 can be aligned with the indexed slots 44.

Figure 2:
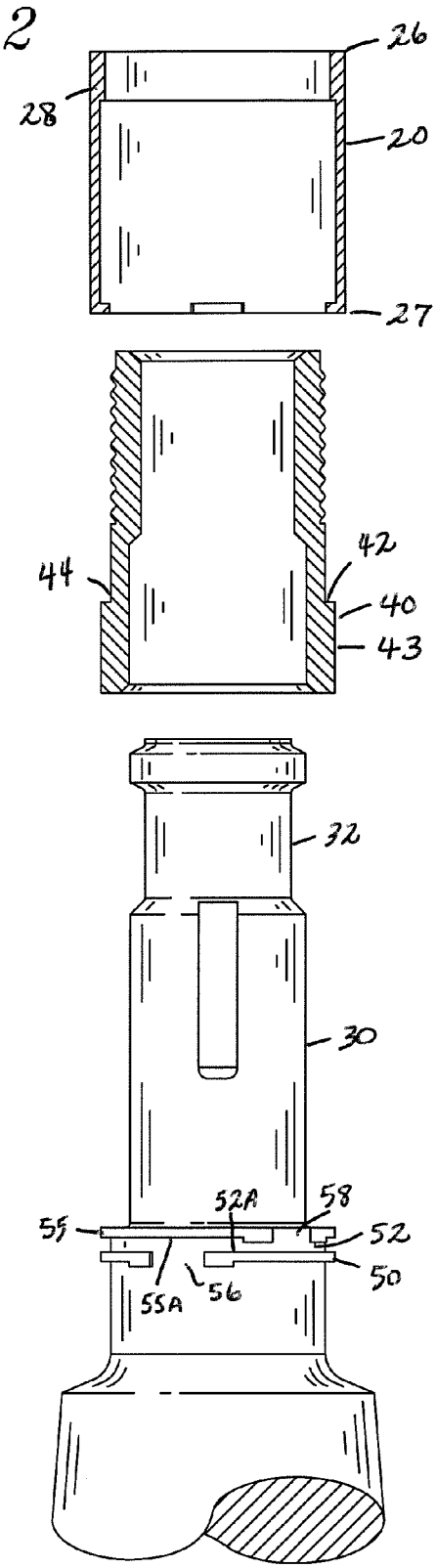
FIG. 2 is an exploded view of the percussion hammer bit system illustrated in FIG. 1.
Figure 3:
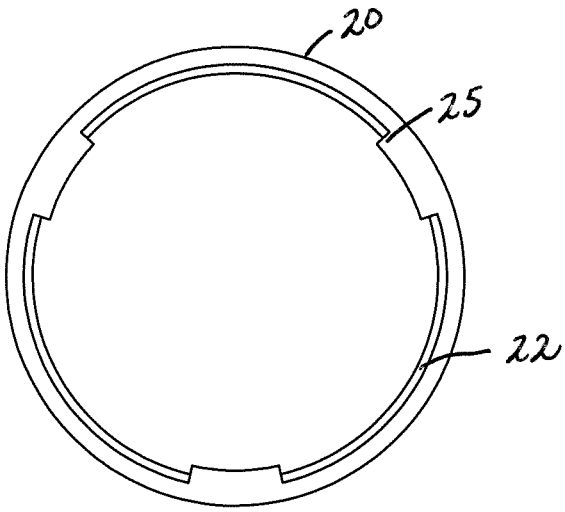
FIG. 3 is a top view of a retainer of the present invention.
Figure 4:
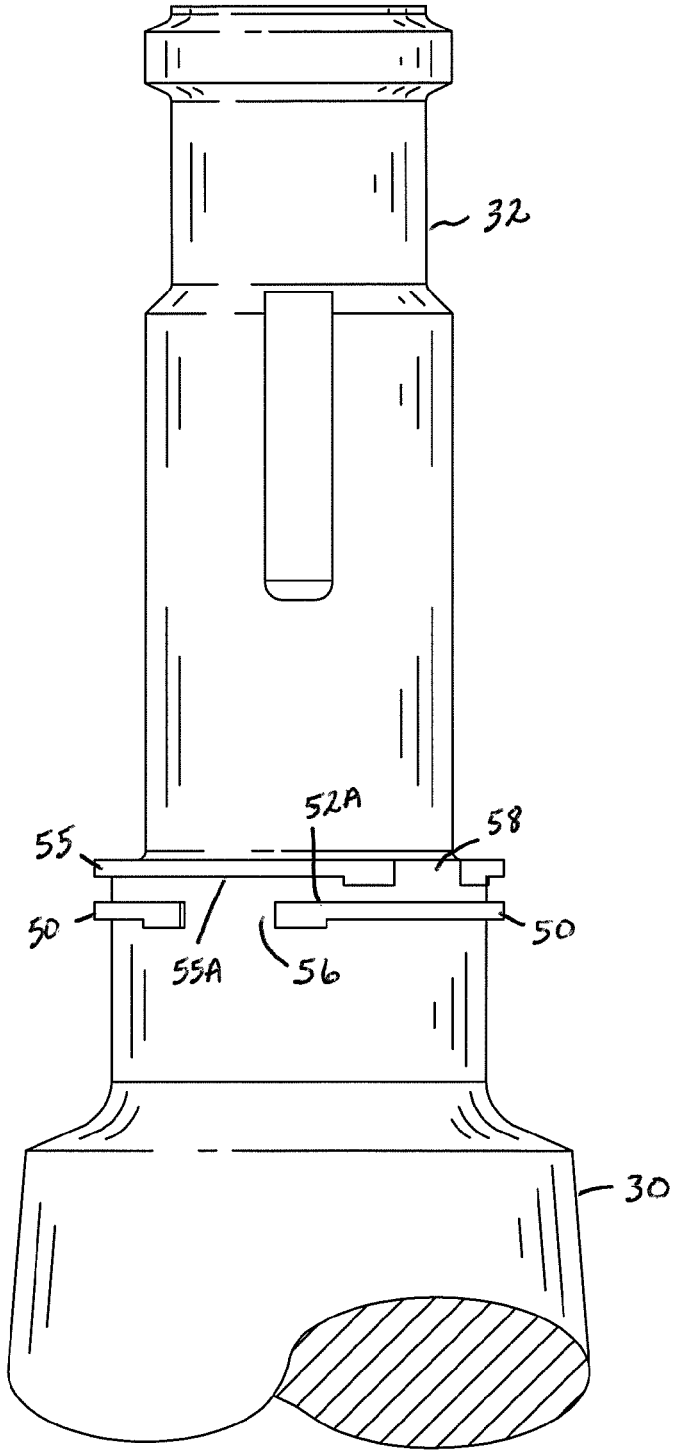
FIG. 4 is a side view of a hammer bit of the present invention.

As best illustrated in FIGS. 1, 2 and 4, the hammer bit 30 defines a first elevated surface 50 and a second elevated surface 55 that defines a pathway 52 disposed between the elevated surfaces 50, 55.

The first elevated surface 50 includes a plurality of first slot openings 56, the number of first slot openings 56 being equal to the number of tabs 25 on the retainer 20. Further, the first slot openings 56 are equally spaced about the circumference of the first elevated surface 50 such that in application, the tabs 25 can be aligned with the first slot openings 56.

The second elevated surface 55 includes a plurality of second slot openings 58, the number of second slot openings 58 being equal to the number of tabs 25 on the retainer 20. Further, the second slot openings 58 are equally spaced about the circumference of the second elevated surface 55 such that in application, the tabs 25 can be aligned with the second slot openings 58.

As will be understood, it is critical that the first slot openings 56 are not in vertical alignment with the second slot openings 58. Further, the indexed slots 44 are not in vertical alignment with the second slot openings 58.

In application, the tabs 25 of the retainer 20 are indexed in a manner that only allows the tabs 25 to pass through the aligned first slot openings 56 on the first elevated surface 50 in one (1) position every 360 degrees if the bit head is separated from the bit or while positive lifting pressure is applied while the hammer bit is not assembled. In the event that the tabs 25 are aligned and pass through the first slot opening 56, the retainer 20 must then be rotated approximately 180 degrees along the pathway 52 with positive pressure applied to the retainer 20 to allow the retainer tabs 25 to rotate while in contact with a top surface 50A of the first elevated surface 50 in order for the tabs 25 to avoid contact with a bottom surface 55A of the second elevated surface 55 or it will interrupt rotation. Once the tabs 25 on the retainer 20 are aligned with the second slot openings 58 on the second elevated surface 55 positive lifting pressure must be applied to free the retainer 20 from the broken section (shank) of the hammer bit. The next step is to align the index retainer tabs 25 with the corresponding indexed slots 44 of the custom chuck 40 in order to fully separate the retainer 20 from the assembly.

It should now be understood that the first elevated surface 50 prevents the tabs 25 from accessing the pathway 52 until the tabs 25 align with the slots 56 as described. Likewise, the second elevated surface 55 prevents the tabs 25 from advancing until the tabs 25 align with the slots 58.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. A percussion hammer bit retention system comprising:
a retainer;
a hammer bit; and
a custom chuck;
wherein said retainer includes an inner surface having a plurality of tabs spaced about the circumference of a lower end of the inner surface, and an edge disposed on an upper end of the inner surface;
wherein said custom chuck includes a ledge disposed on an outer surface, wherein said edge is in abutting communication with the ledge, said ledge further defines a plurality of spaced indexed slots, the number of indexed slots being at least equal to the number of tabs on the retainer such that the tabs can be aligned with the indexed slots;
wherein said hammer bit defines a first elevated surface and a second elevated surface and a pathway therebetween, said first and second elevated surfaces extend circumferentially around said hammer bit, and wherein said first elevated surface having a plurality of spaced first slot openings, the number of first slot openings being at least equal to the number of tabs on the retainer such that the tabs can be aligned with the first slot openings, said second elevated surface includes a plurality of spaced second slot openings, the number of second slot openings being at least equal to the number of tabs on the retainer such that the tabs can be aligned with the second slot openings, wherein said first slot openings are not in vertical alignment with said second slot openings and, said indexed slots are not in vertical alignment with said second slot openings.

2. The percussion hammer bit as recited in claim 1, wherein said tabs are equally spaced about the circumference of the lower end of the inner surface.

3. The percussion hammer bit as recited in claim 1, wherein said retainer has a cylindrical configuration.

4. The percussion hammer bit as recited in claim 3, wherein the circumference of said inner surface is sized to fit over and receive said custom chuck.

5. The percussion hammer bit as recited claim 4, wherein said custom chuck further includes an inner surface sized to receive an upper shaft portion of said hammer bit.

6. The percussion hammer bit as recited in claim 4, wherein said edge serves as a stop in order to prevent the custom chuck from passing completely through the retainer.

7. The percussion hammer bit as recited in claim 1, wherein said inner surface has three (3) tabs spaced about the circumference of the lower end of the inner surface.

8. The percussion hammer bit as recited in claim 7, wherein said three (3) tabs are equally spaced.

9. A percussion hammer bit retention system comprising:
a retainer;
a hammer bit; and
a custom chuck;
wherein said retainer includes an inner surface having a plurality of tabs spaced about the circumference of a lower end of the inner surface, and an edge disposed on an upper end of the inner surface;

wherein said custom chuck includes a ledge disposed on an outer surface, wherein said edge is in abutting communication with the ledge, said ledge further defines a plurality of spaced indexed slots, the number of indexed slots being equal to at least the number of tabs on the retainer such that the tabs can be aligned with the indexed slots;

wherein said hammer bit defines a first elevated surface, wherein said first elevated surface having a plurality of spaced first slot openings, the number of first slot openings being equal to at least the number of tabs on the retainer such that the tabs can be aligned with the first slot openings, wherein said first elevated surface extends circumferentially around said hammer bit.

10. The percussion bit as recited in claim 9, wherein the first slot openings are not in vertical alignment with said indexed slots.

11. The percussion hammer bit as recited in Clam 9, wherein said hammer bit defines a second elevated surface and a pathway between said first elevated surface and said second elevated surface, wherein said second elevated surface includes a plurality of spaced second slot openings, the number of second slot openings being at least equal to the number of tabs on the retainer such that the tabs can be aligned with the second slot openings, wherein said first slot openings are not in vertical alignment with said second slot openings.

12. The percussion bit as recited in claim 11, wherein said indexed slots are not in vertical alignment with said second slot openings, and wherein said second elevated surface extends circumferentially around said hammer bit.

13. The percussion hammer bit as recited in claim 9, wherein said tabs are equally spaced about the circumference of the lower end of the inner surface.

14. The percussion hammer bit as recited in claim 9, wherein said inner surface has three (3) tabs spaced about the circumference of the lower end of the inner surface.

15. The percussion hammer bit as recited in claim 14, wherein said three (3) tabs are equally spaced.

16. A percussion hammer bit retention system comprising:

a retainer;

a hammer bit; and a custom chuck;

wherein said retainer includes an inner surface having a plurality of tabs spaced about the circumference of a lower end of the inner surface, and an edge disposed on an upper end of the inner surface;

wherein said custom chuck includes a ledge disposed on an outer surface, wherein said edge is in abutting communication with the ledge;

wherein said hammer bit defines a first elevated surface and a second elevated surface and a pathway therebetween, said first and second elevated surfaces extend circumferentially around said hammer bit, said first elevated surface having a plurality of spaced first slot openings, the number of first slot openings being at least equal to the number of tabs on the retainer such that the tabs can be aligned with the first slot openings, and said second elevated surface includes a plurality of spaced second slot openings, the number of second slot openings being at least the number of tabs on the retainer such that the tabs can be aligned with the second slot openings, wherein said first slot openings are not in vertical alignment with said second slot openings.

17. The percussion hammer bit as recited in claim 16, wherein said ledge further defines a plurality of spaced indexed slots, the number of indexed slots being at least equal to the number of tabs on the retainer such that the tabs can be aligned with the indexed slots, and wherein said indexed slots are not in vertical alignment with said second slot openings.

18. The percussion hammer bit as recited in claim 16, wherein said inner surface has three (3) tabs spaced about the circumference of the lower end of the inner surface.

19. The percussion hammer bit as recited in claim 18, wherein said three (3) tabs are equally spaced.

* * * * *